United States Patent [19]

Quenzi

[11] Patent Number: 4,658,519

[45] Date of Patent: Apr. 21, 1987

[54] SNOWPLOW AND IMPLEMENT ATTACHMENT MEANS FOR A VEHICLE

[75] Inventor: Philip J. Quenzi, Atlantic, Mich.

[73] Assignee: W. Wally Niemela, Chassell, Mich.

[21] Appl. No.: 762,580

[22] Filed: Aug. 5, 1985

[51] Int. Cl.[4] ..... E01H 5/04

[52] U.S. Cl. ..... 37/23; 37/235; 37/273; 172/272; 172/275; 414/723

[58] Field of Search ..... 37/273, 274, 231, 232, 37/235; 172/816, 818, 819, 820, 821, 272, 275, 248; 414/726, 686, 723, 724; 280/477, 479 R, 47 A, 490 A

[56] References Cited

U.S. PATENT DOCUMENTS

| | | | |
|---|---|---|---|
| 574,567 | 1/1897 | Pepin . | |
| 595,202 | 12/1897 | Pearson et al. | 37/217 |
| 1,307,410 | 6/1919 | Morris . | |
| 1,365,153 | 1/1921 | Clark | 37/232 |
| 1,453,811 | 5/1923 | Starkweather . | |
| 1,455,494 | 5/1923 | Johnson . | |
| 1,570,267 | 1/1926 | Mackenzie et al. . | |
| 1,927,078 | 9/1933 | Weeks | 37/44 |
| 1,957,103 | 5/1934 | Frink | 37/42 |
| 2,059,431 | 11/1936 | Barrett et al. | 37/144 |
| 2,078,294 | 4/1937 | Stiehl et al. | 214/138 |
| 2,218,512 | 10/1940 | Ball | 37/42 |
| 2,219,159 | 10/1940 | Flynn et al. | 47/144 |
| 2,502,681 | 4/1950 | Swanson | 37/144 |
| 2,577,145 | 12/1951 | Nearing et al. | 37/231 |
| 2,590,143 | 3/1952 | Adams, Jr. et al. | 37/53 |
| 2,643,470 | 6/1953 | Kaeser | 37/42 |
| 2,643,472 | 6/1953 | Merz | 37/273 |
| 2,645,043 | 7/1953 | Booton et al. | 37/98 |
| 2,667,708 | 2/1954 | Gjesdahl | 37/231 |
| 2,698,096 | 12/1954 | Hughes | 212/144 |
| 2,698,491 | 1/1955 | Felt | 37/144 |
| 2,702,212 | 2/1955 | McAneny | 305/9 |
| 2,793,880 | 5/1957 | Uehler et al. | 172/272 X |
| 2,904,116 | 9/1959 | Wessendorf | 172/275 |
| 2,974,762 | 3/1961 | Hunnebeck | 189/37 |
| 3,019,536 | 2/1962 | Kershaw | 37/104 |
| 3,157,099 | 11/1964 | Ulrich | 94/46 |
| 3,201,878 | 8/1965 | Markwardt | 37/42 |
| 3,250,026 | 5/1966 | Jocher et al. | 37/42 |
| 3,307,275 | 3/1967 | Simi | 37/42 |
| 3,365,822 | 1/1968 | Howie | 37/42 |
| 3,378,084 | 4/1978 | Ulrich | 172/247 |
| 3,388,929 | 6/1968 | Miley | 37/231 X |
| 3,410,008 | 11/1968 | Standfuss | 37/231 |
| 3,425,497 | 2/1969 | Strabala et al. | 172/792 |
| 3,432,949 | 3/1969 | Glesmann | 37/231 |
| 3,512,804 | 5/1970 | Siegart | 37/231 |
| 3,706,144 | 12/1972 | Miceli | 37/42 |
| 3,803,733 | 4/1974 | Ramsey | 37/44 |
| 3,845,577 | 11/1974 | Naymik | 37/231 |
| 3,881,261 | 5/1975 | Lavoie | 37/46 |
| 3,898,753 | 8/1975 | Kinnunen | 37/46 |
| 3,964,622 | 6/1976 | Blair et al. | 414/723 |
| 3,987,562 | 10/1976 | Deen et al. | 37/231 |
| 4,056,250 | 11/1977 | Uchiyama | 172/272 X |
| 4,074,448 | 2/1978 | Niemela | 37/232 |

FOREIGN PATENT DOCUMENTS

| | | | |
|---|---|---|---|
| 1503496 | 11/1967 | France | 37/232 |
| 562374 | 5/1975 | Switzerland | 37/273 |

*Primary Examiner*—E. H. Eickholt

*Attorney, Agent, or Firm*—Price, Heneveld, Cooper, DeWitt & Litton

[57] ABSTRACT

A hinged snowplow includes a T-shaped support frame for attachment to a vehicle, the support frame having a free end. A cowling having a pair of extending plow blades pivotally secured thereto, is pivotally secured to the free end so as to pivot in a generally vertical plane about the free end. The cowling has a first stop engageable with the support frame to limit pivotal movement of the cowling about the frame to a first or normal plowing position. A second stop on the cowling is engageable with the support frame to limit the pivotal movement of the cowling about the frame to a second or tipped position. A trip bias mechanism between the frame and the cowling biases the cowling and plow blades to the first position in which the blades are normally positioned for plowing. The cowling and blades are rotated against the trip bias mechanism toward the second, tipped position when the blades hit an obstacle.

42 Claims, 11 Drawing Figures

SNOWPLOW AND IMPLEMENT ATTACHMENT MEANS FOR A VEHICLE

BACKGROUND OF THE INVENTION

This invention relates to articulated snowplows, and to means for attaching snowplows to motor vehicles.

Plows with blades which articulate or hinge have a number of advantages over plows with straight, nonpivotal blades. In deep snow, a lightweight vehicle carrying a plow, such as a jeep or pickup truck, often cannot push snow with a straight blade. The wheels of the vehicle will spin when the resistance of the deep snow is encountered. With a hinged blade, however, in a forwardly extending V configuration, the same deep snow can be pushed to either side of a lightweight vehicle, and the vehicle will not get stuck.

A straight bladed plow also makes it virtually impossible to push an entire pile of snow to an out-of-the-way location since the snow will spill out either side of the plow. However, a hinge plow can be articulated to a rearwardly extending V position such that a pile of snow can be cupped between the two blade portions and pushed without significant spillage.

A problem encountered with many prior art hinged plows, however, is that the hinge cannot withstand the severe stresses which occur when objects such as curbs, rocks and the like buried beneath the snow are struck. In many prior art designs, the hinge bends or fails after repeated strikes, making it difficult or impossible to articulate the blades. Another problem is with the complicated mechanical design used in many hinge plows. Such complexity leads to costly repairs.

SUMMARY OF THE INVENTION

The present invention is a hinged snowplow wherein a cowling is pivotally secured to the free end of the support frame which attaches to the vehicle such that the cowling pivots in a generally vertical plane about the free end of the frame. The blades of the hinged snowplow are hinged to the cowling. A first stop is connected to the cowling and is engageable with the support frame to limit pivotal movement of the cowling and plow blades about the frame to a first or normal plowing position. A second stop, connected with the cowling and engageable with the support frame, limits the pivotal movement of cowling and plow blades about the frame to a second position so that the cowling and the blades can pivot as a unit only between the two positions. This allows a rock or other object to pass underneath the blades if the blades strike such an object. Trip bias means between the frame and the cowling bias the cowling and the blades to the first position where the blades are positioned for plowing. When an object is struck, the blades move toward the second position against the bias means as limited by the second stop.

In other aspects, the invention includes a quick-disconnect attachment for connecting the plow support frame to a vehicle. Such attachment includes first and second cooperating hitch means, one on the vehicle and the other on the plow support frame. One of the hitch means includes at least one projection, while the other has a slot receiving the projection. A movable pin on one hitch means, controllable from a remote location such as the cab of the vehicle, locks behind a fixed rod on the other hitch means to retain the plow support frame to the vehicle. Preferably, the projection forms a second slot which receives the fixed rod, the rod extending across the first of the slots. The movable pin extends across the second slot.

In yet another aspect, the support frame for the plow is formed in a T-shape with the arm or cross of the T closest to the vehicle. The free end of the leg of the T supports the hinged plow. Preferably, the trip bias means is connected between the arm of the T and the cowling which is supported at the free end of the support frame.

The cowling provides a strong, localized reinforcement for the hinge so that the hinge can resist repeated strikes of buried objects without bending or failing. Furthermore, the cowling allows attachment of the fluid cylinders which position the plow blades and the biasing mechanism for the trip bias means, and is relatively simple in mechanical design so that it is very economical to manufacture. The attachment allows easy connection and removal of the entire plow to and from a vehicle without leaving the driver's seat. The support frame provides improved strength for the plow, while allowing all necessary plow movement.

DETAILED DESCRIPTION OF THE PREFERRED EMBODIMENT

Figure 1:
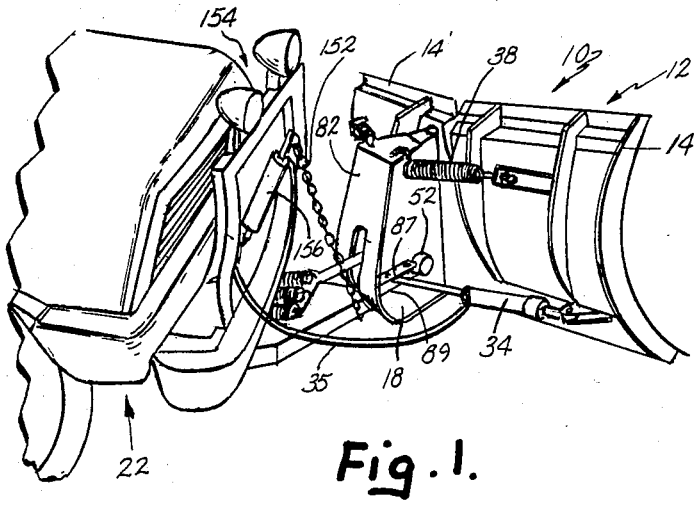
FIG. 1 is a perspective view of a vehicle having the snowplow of the present invention attached.

The snowplow 10 of the present invention includes a blade 12 made of two half blade sections 14, 14' which are hinged together at a generally vertical hinge 16 mounted on a cowling 18. Cowling 18 is pivotally mounted for horizontal pivotal movement on the free end of a T-shaped support frame 20. Frame 20 is releasably mounted on a vehicle such as a pickup truck 22 by means of a first hitch 24 attached to support frame 20 and a second hitch 26 mounted on the vehicle.

Blade 12 and its half sections 14, 14' are in the configuration of a standard, articulated, rectilinear plow and need not be described in great detail. Each blade half is reinforced in the conventional manner and has downwardly extending skid cups 28, 28' which support the ends of blade 12 while the plow is being pushed by vehicle 22 across a surface to be plowed. Blade sections 14, 14' are hinged together and hingeably attached to the apex 30 of cowling 18 by a hinge 16. Hinge 16 includes two hinge flanges 32, 32' each of which is welded to one of the half blade sections 14, 14'. Each hinge flange has a series of annular hinge collars or bushings 33, 33' (FIG. 4) which receive a connecting hinge pin 76 to interfit and alternate with one another and provide hinged blade movement.

Each half blade section 14, 14' is independently pivotal about hinge 16 by means of fluid cylinders 34, 34' (FIGS. 2 and 6–8) which are preferably single-acting hydraulic cylinders. Each cylinder 34, 34' is connected to its half blade section by a tab 36, 36' welded to the back of half blade sections 14 and 14'. The other end of each hydraulic cylinder 34 is pivotally mounted on cowling 18 in a manner to be described. Cylinders 34 are each connected to a conventional source of pressurized fluid on the vehicle, such as a hydraulic pump (not shown), via fluid/hydraulic lines 35, 35' and are controlled by conventional fluid/hydraulic valves (not shown) operable from the vehicle cab in the conventionally known manner.

Figure 6:
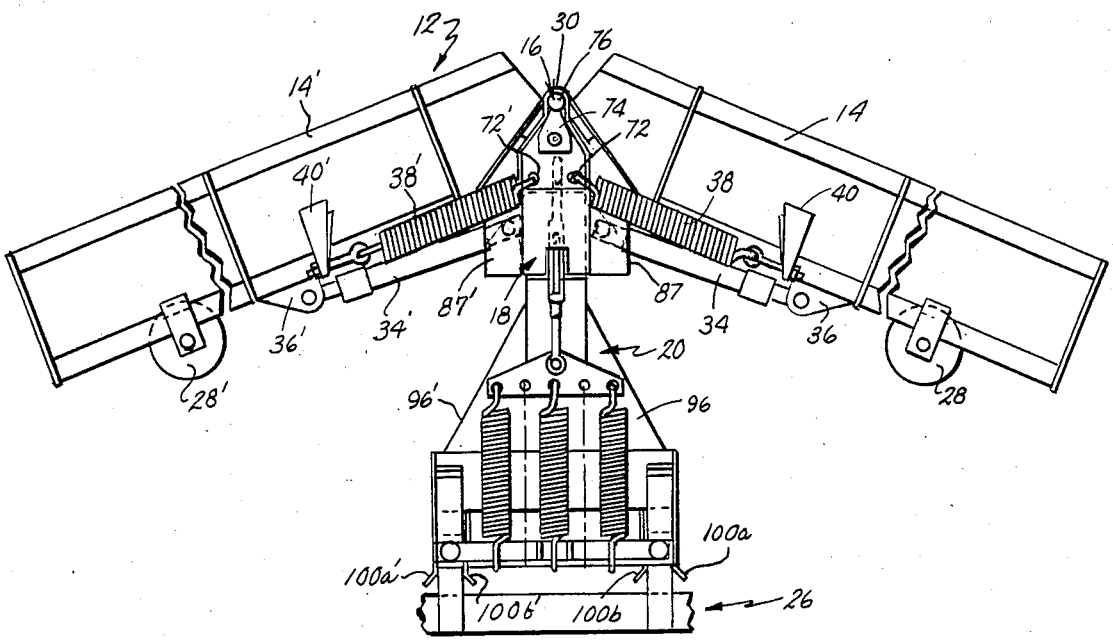
FIG. 6 is a top plan view of the snowplow with the plow blades positioned in a forwardly extending V configuration.
Figure 8:
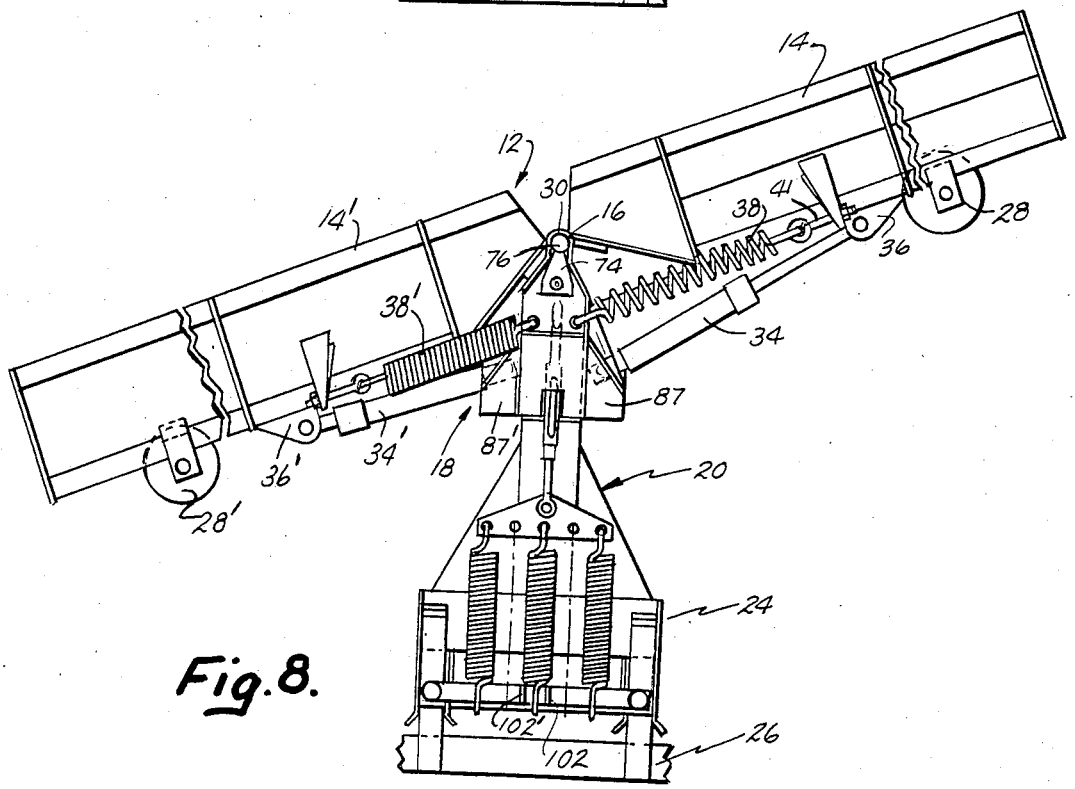
FIG. 8 is a top plan view of the snowplow of the present invention with the plow blades aligned but rotated to an angled position.

Blade sections 14, 14' are independently retractable and biased rearwardly by means of retraction springs 38, 38' which allow the blade to assume the rearwardly angled positions illustrated in FIGS. 6 and 8 when fluid is exhausted from cylinders 34, 34'. Retraction springs 38, 38' are attached to blade sections 14, 14' by brackets 40, 40' welded near the tops of the backs of the blades. Retraction springs 38, 38' are connected to brackets 40, 40' by eyebolts 41, 41' which can be threaded into or out of brackets 40, 40' to adjust the tension of springs 38, 38'. Retraction springs 38, 38' are connected at their other ends to the top of cowling 18 (FIG. 4) in a manner to be described.

Figure 3:
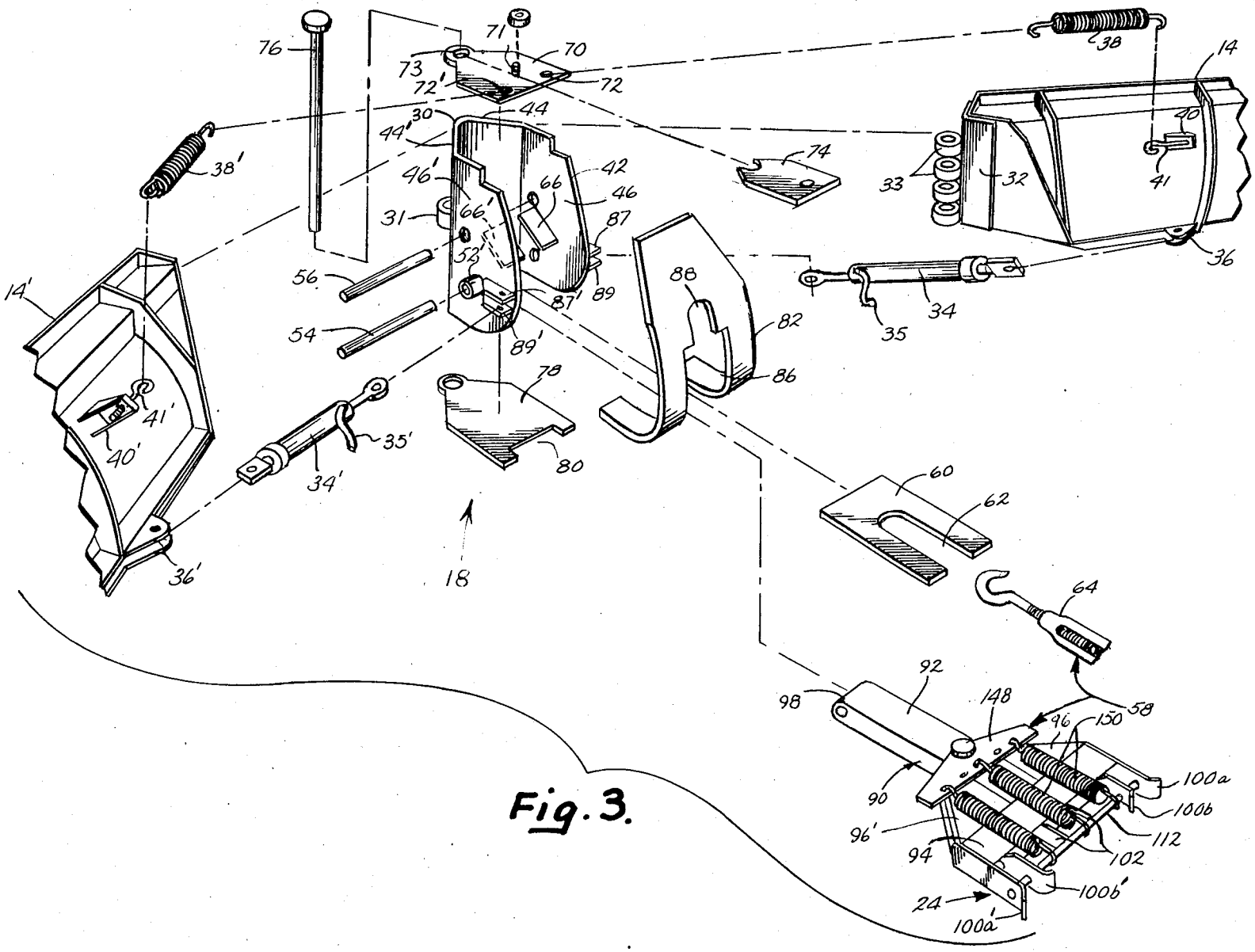
FIG. 3 is a rear, detailed, exploded perspective view of the hinged snowplow of the present invention.
Figure 4A:
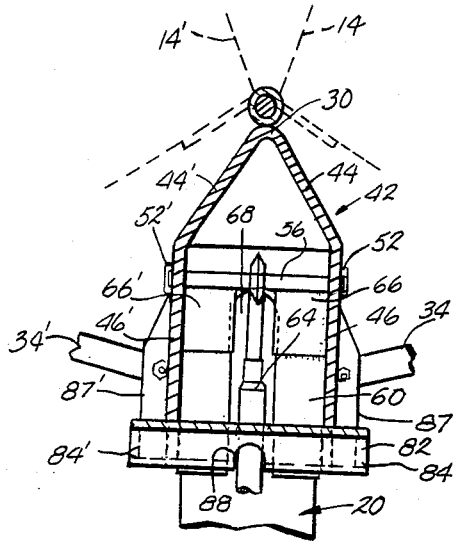
FIG. 4A is a sectional view of the snowplow taken along line IVA—IVA of FIG. 4.
Figure 4:
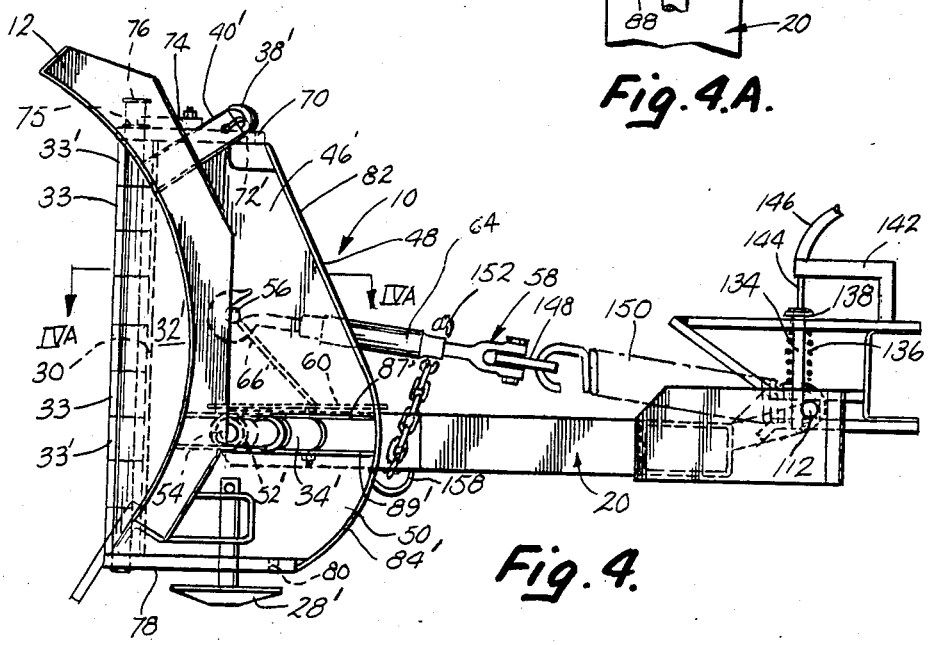
FIG. 4 is a side view of the snowplow of the present invention with the blade in the normal, untripped, plowing position.

The primary component of cowling 18 is a V-shaped, one-piece stamping 42 having two apex plate portions 44, 44' (FIG. 4A) which form an elongated, vertically extending apex 30 when blade 12 is in the untripped position (FIG. 4). Apex 30 supports hinge 16 throughout its entire length. A bushing 31 (FIGS. 3 and 4) is welded to the center of apex 30 to receive hinge pin 76 for connecting the center of cowling 18 to half blade sections 14, 14'. Stamping 42 further includes two parallel wall portions 46, 46' which extend rearwardly from apex plate portions 44, 44'. Each of the parallel wall portions has a downwardly sloped upper rear edge 48 and a curved lower rear edge 50.

Bushings 52, 52' (FIGS. 3 and 4A) are positioned along the lower, forward part of each parallel wall portion 46, 46' to receive a pivot rod 54 (FIGS. 3, 4 and 5) which forms a horizontal pivot axis to allow the trip motion described below and pivotally secures the free end of support frame 20 to cowling 18 between the parallel wall portions 46. Also extending between parallel wall portions 46 above rod 54 is an attachment rod 56 to which the trip bias mechanism 58 is attached for biasing cowling 18 and blade 12 to the vertical position shown in FIGS. 2, 4 and 6–8.

Figure 5:
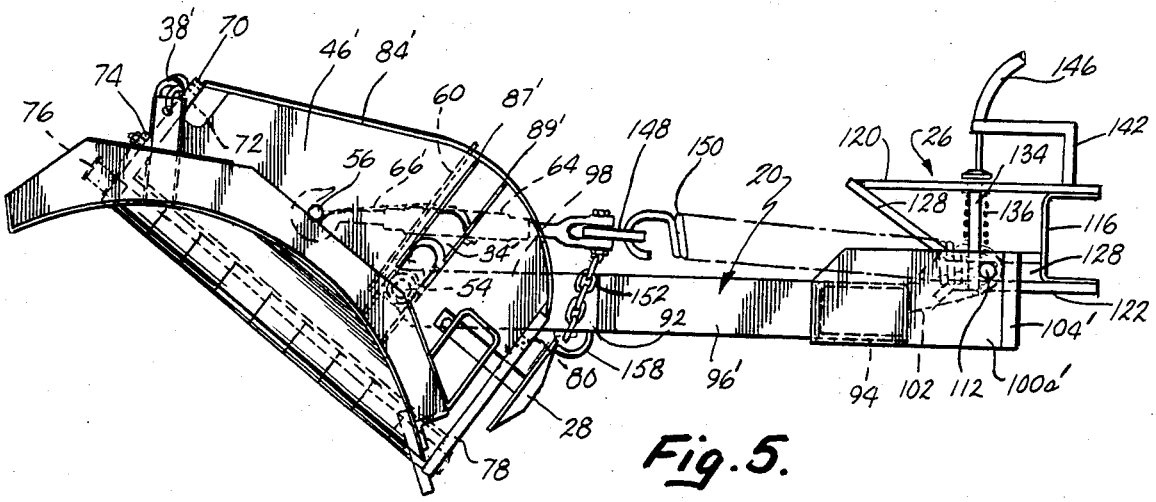
FIG. 5 is a side view of the snowplow with the blade in the tripped position.
Figure 7:
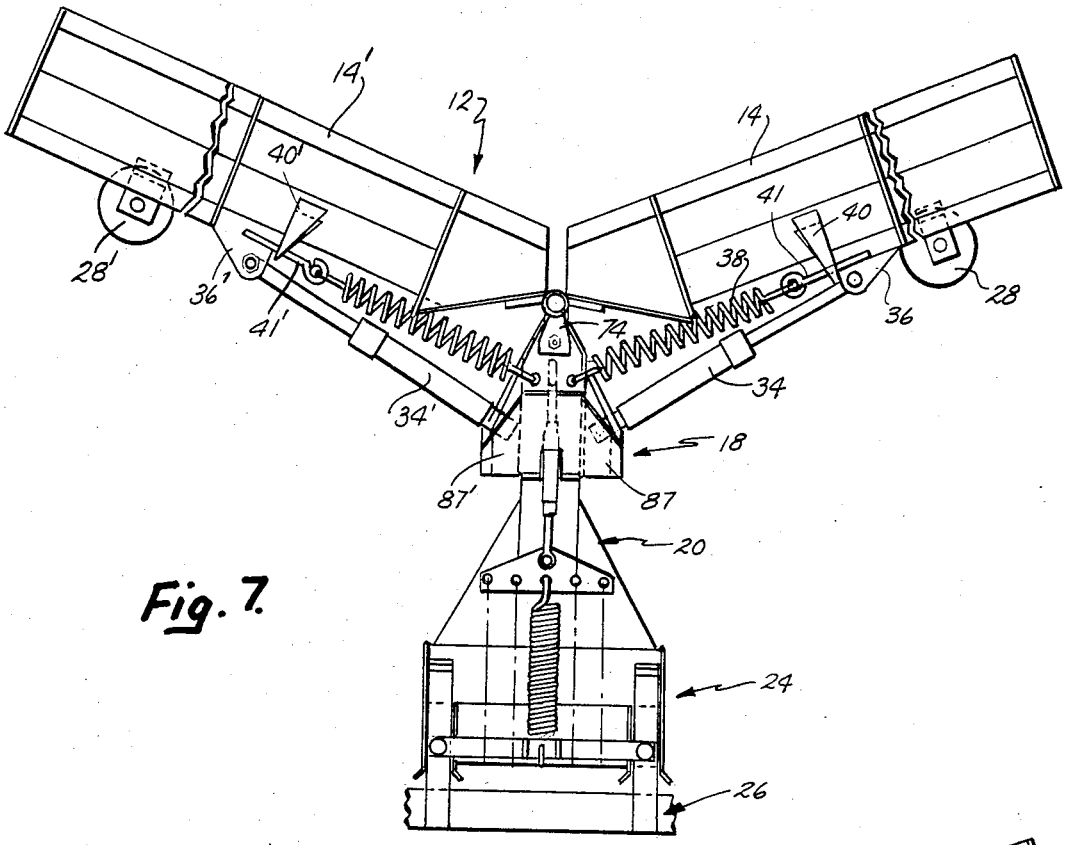
FIG. 7 is a top plan view of the snowplow of the present invention with the plow blades in a rearwardly extending V configuration.

A stop plate 60 is also positioned transversely between and welded to parallel wall portions 46, 46' also above rod 54 but below rod 56. Stop plate 60 abuts against the upper surface of the free end of support frame 20 when cowling 18 is in the vertical position, forming a stop preventing further rearward pivoting of cowling 18 and blade 12 beyond their vertical position illustrated in FIG. 4. Stop plate 60 has a slot 62 (FIGS. 3 and 4A) which opens rearwardly and receives turnbuckle 64 of trip bias mechanism 58 when blade 12 and cowling 18 are tripped as shown in FIG. 5.

Two buttress plates 66, 66' (FIGS. 3, 4 and 4A) extend between stop plate 60 and attachment rod 56 to buttress attachment rod 56 against bending by trip bias mechanism 58. The two buttress plates 66, 66' are separated by a gap 68 through which turnbuckle 64 passes when cowling 18 and blade 12 are in the fully tripped position illustrated in FIG. 5. Furthermore, gap 68 allows turnbuckle 64 to be hooked onto attachment rod 56 (FIG. 4A).

Cowling 18 further includes a top plate 70 which covers the top of cowling 18 between plate portions 44 and wall portions 46. Top plate 70 has two spaced openings 72, 72' near its rear edge to which the interior ends of retraction springs 38, 38', respectively, are attached. Its forward end includes an aperture 73 in a forwardly projecting flange for receiving hinge pin 76 for connecting the top of cowling 18 to the half blade sections 14, 14'. Mounted on top plate 70 is a locking plate 74 which is bolted to the top of top plate 70 with bolt 71 and abuts against a flange 75 (FIG. 4) spaced below the top of hinge pin 76, which pin extends the entire length of hinge 16. Locking plate 74 prevents pin 76 from working out of hinge 16 as the blades are repeatedly articulated.

Cowling 18 further includes a bottom plate 78 which covers the bottom of cowling 18 between plate portions 44 and wall portions 46. Bottom plate 78 includes a recess or slot 80 along its rear edge which accommodates the free end of support frame 20 when cowling 18 and blade 12 are tripped as shown in FIG. 5. Slot 80 receives the free end of support frame 20 so that bottom plate 78 will not interfere with the full pivotal movement of cowling 18 about support frame 20 to the fully tripped position illustrated in FIG. 5. The forward end of bottom plate 78 includes an aperture 79 in a projecting flange which receives the bottom end of hinge pin 76 and connects the bottom of cowling 18 to the half blade sections.

Cowling 18 also has a curved rear plate 82 which conforms generally to the shape of the upper rear edges 48 and curved lower edges 50 of parallel wall portions 46. Rear plate 82 extends from top plate 70 to bottom plate 78, and also extends between and beyond parallel wall portions 46 forming outwardly extending wings or flanges 84, 84' (FIG. 4A) on either side of the rear cowling. Flanges 84 and 84' reinforce parallel wall portions 46, 46' and engage reinforcing gussets 87, 87' as will be described below.

Rear plate 82 has an enlarged opening 86 which extends from stop plate 60 down to bottom plate 78 which is as wide as the width of the free end of support frame 20. Opening 86 allows cowling 18 to pivot from the first, vertical position illustrated in FIG. 4 to a second, tripped position illustrated in FIG. 5. Extending upwardly from opening 82 is a turnbuckle slot 88 (FIGS. 2, 3 and 4A) through which turnbuckle 64 extends. Slot 88 opens to opening 86, permitting turnbuckle 64 to move into opening 86 when the cowling pivots to the fully tripped position.

Welded to the exterior surface of each parallel wall portion 46, 46' are a pair of spaced, horizontal gussets 87, 89 and 87', 89' (FIG. 3). Each pair of gussets extend from a bushing 52 or 52' rearwardly to one of the flanges 84 or 84'. Flanges 84 and 84' are also welded to gussets 87, 89 and 87', 89', respectively. Gussets 87, 89 and 87', 89' reinforce parallel wall portions 46, 46' between bushings 52, 52' and flanges 84, 84' in order to strengthen those parts of wall portions 46, 46' which will be under the greatest stress when snow is plowed because the force of plowing will be transmitted through pivot rod 54 and bushing 52 to frame 20.

Support frame 20 (FIGS. 2, 3, 6–8 and 10) includes a T-frame 90 with a forwardly extending leg portion 92 which is perpendicular and welded to an arm or cross portion 94. Gussets 96, 96' extend between leg portion 92 and arm portion 94 to reinforce T-frame 90. Leg portion 92 extends forwardly beyond gussets 96, forming the free end 98 of support frame 20 which extends into and is pivotally secured to cowling 18.

Figure 10:
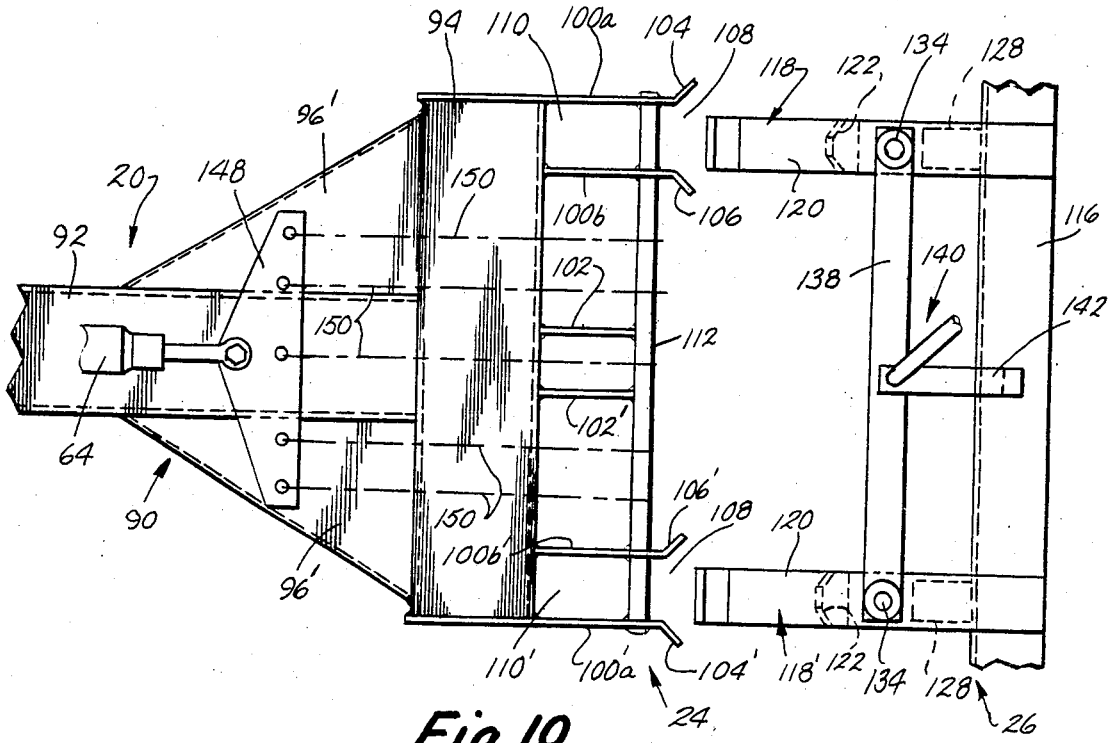
FIG. 10 is a detailed, top plan view of the attachment hitch of the present invention.

Extending rearwardly from arm portion 94 are two pairs of side ears 100*a*, 100*b* and 100*a*', 100*b*', and a pair of central ears 102, 102'. Each pair of ears 100*a*, 100*b* is identical to the other, so only one will be described in detail. Ear 100*a* is an extension of a side plate welded over the end of arm portion 94 and extends rearwardly therefrom. The rear end of ear 100*a* terminates in an outwardly flared, angled end 104 (FIG. 10). Ear 100*b* is spaced inwardly from ear 100*a* and terminates in a flared, inwardly bent end 106 which projects in a direction away from flared end 104 of ear 100*a*. Thus, flared ends 104 and 106 of ears 100*a* and 100*b* form an enlarged opening 108 to a slot 110 formed between ears 100*a* and 100*b*.

Extending parallel to an entire length of arm portion 94 and through ears 100*a*, 100*b*, 100*b*' and 100*a*' is a retaining rod 112. Ears 102, 102' are positioned intermediate the ends of retaining rod 112 and extend between the center portion of retaining rod 112 and arm portion 94 to reinforce retaining rod 112 against bending in its middle. Ears 100*a*, 100*b*, 100*b*' and 100*a*' and retaining rod 112 form first hitch 24.

Figure 9:
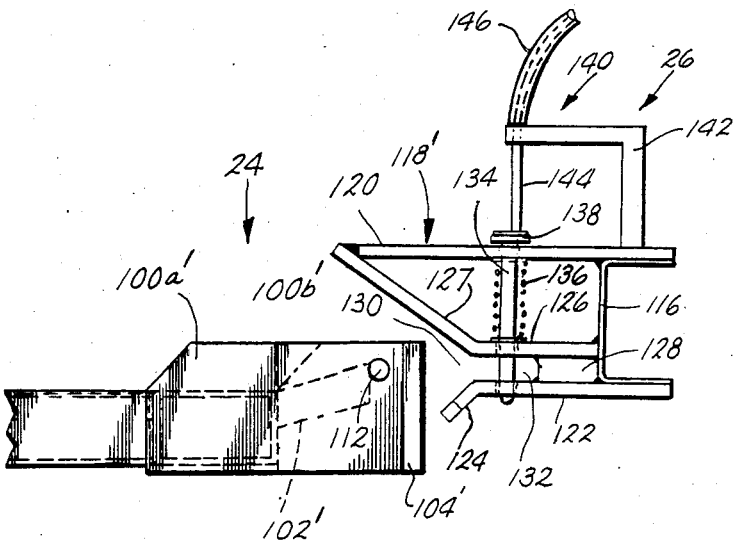
FIG. 9 is a side view of the attachment hitch for the snowplow of the present invention.

Mounted on the vehicle 22 is second hitch 26 which includes a mounting bar 116 to mount hitch 26 on the vehicle, preferably to the chassis of the vehicle. Extending forwardly from mounting bar 116 are two spaced projections which provide catch assemblies 118, 118', each of which is identical to the other, so only one will be described. Projection or catch assembly 118 includes a top plate 120 (FIGS. 9 and 10) which is welded to the top of mounting bar 116 and extends forwardly therefrom. A bottom ear 122 is welded to and extends forwardly from the bottom of mounting bar 116 and terminates in a downwardly angled flared end 124 (FIG. 9). An upper ear 126 is welded to mounting bar 116 intermediate top plate 120 and bottom ear 122. Upper ear 126 includes an upwardly angled portion 127 (FIG. 9) which angles away from the flared end 124 of bottom ear 122. The forward end of angled portion 127 is welded to the forward end of top plate 120. Angled portion 127 and flared end 124 form an enlarged mouth 130 leading to a slot 132 formed between bottom ear 122 and upper ear 126. A support block 128 (FIGS. 9 and 10) is positioned between upper ear 126 and bottom ear 122 and is welded to the two ears as well as mounting bar 116 to reinforce hitch 26. Thus, slots 132, 132' are transverse to slots 110, 110' since ears 120, 122, and 126 and 120', 122' and 126' are transverse to ears 100*a*, 100*b* and 100*a*', 100*b*'.

Figure 2:
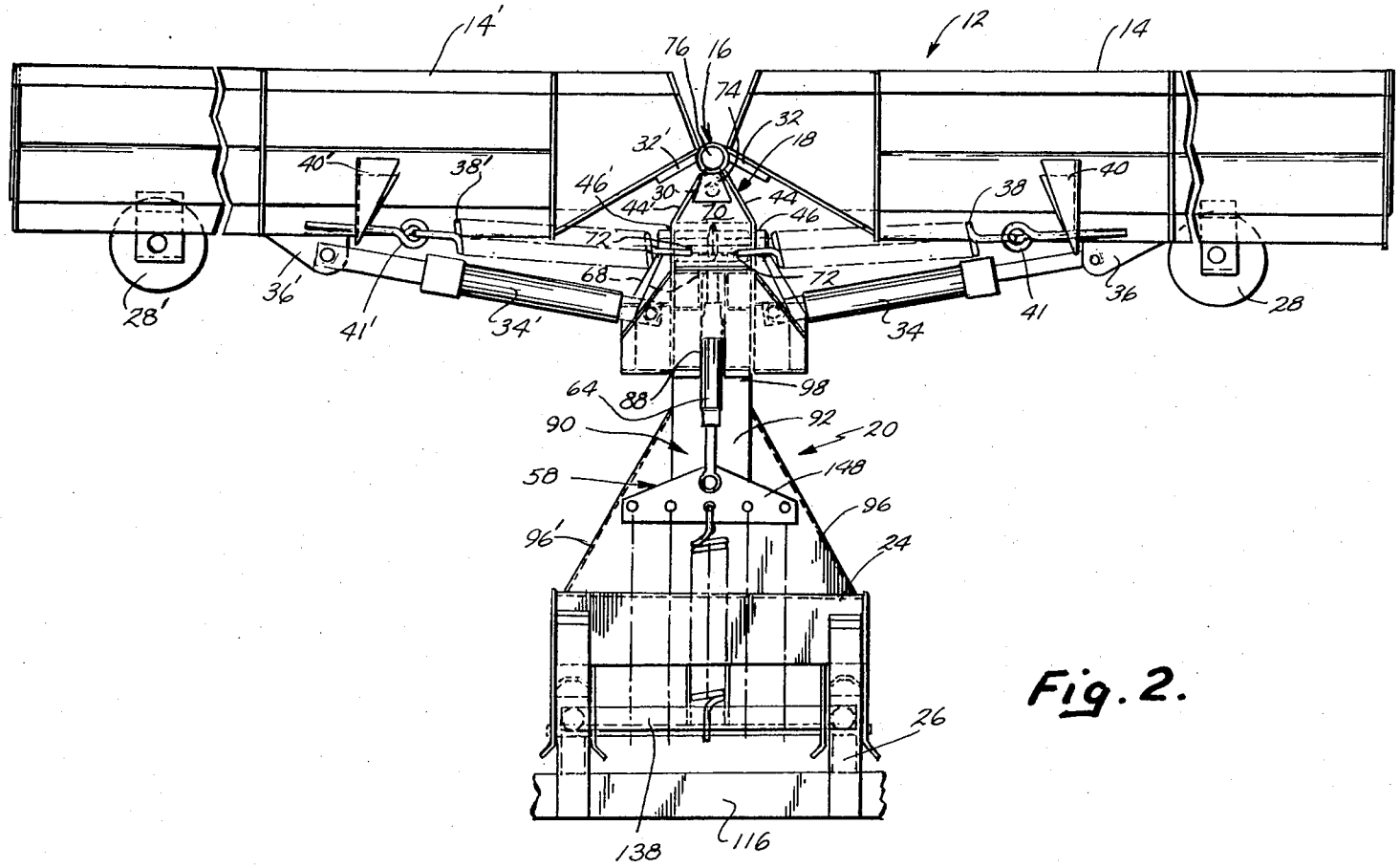
FIG. 2 is a top plan view of the snowplow of the present invention.

A movable pin 134 projects downwardly through top plate 120, upper ear 126 and bottom ear 122, across slot 132 (FIG. 9) transverse to rod 112. Pin 134 is biased downwardly and across slot 132 by a spring 136 engaging an annular flange 137 fixed on pin 134. When pin 134 is raised upwardly against the bias spring 136, the portion of retaining rod 112 between ears 100*a* and 100*b* can be slipped into slot 132. Pin 134 is then lowered to capture retaining rod 112 in slot 132 as shown in FIGS. 2 and 5. When locked within slots 132, 132' by pins 134, rod 112 forms a horizontal pivot axis for the entire support frame/plow assembly with respect to the vehicle on which it is mounted. The entire assembly may be raised and lowered about rod 112 by a lifting mechanism as described below.

The two catch assemblies 118, 118' are as far apart as the two pairs of outer ears 100 as can be seen from FIG. 10. Thus, the portions of retaining rod 112 between ears 100*a* and 100*b* and ears 100*a*' and 100*b*' can be captured within the slots 132 in the two catch assemblies 118. It is desirable to move the two pins 134 in tandem. To do this, a lift bar 138 is connected to the upper ends of both pins 134 and extends between the two catch assemblies 118. When lift bar 138 is raised, pins 134 will be raised in tandem to allow retaining rod 112 into slots 132 and allow projecting ears 126 and 122 into slots 110.

A shielded cable assembly 140 actuates lift bar 138. Cable assembly 140 includes an L-shaped bracket 142 mounted on mounting bar 116, a cable 144 connected to the middle of lift bar 138 and extending through an aperture in the free end of bracket 142, and a cable shield 146 with one end secured to the free end of bracket 142. The other end of the shielded cable is actuated by a lever or the like located inside the cab of the vehicle. By activating the lever, cable 144 will pull lift bar 138 and pins 134 upwardly either to release the plow or to hitch the plow. In either event, it can be seen that hitching or unhitching the plow is quite simple and can be accomplished by the vehicle driver from his driver's position. In fact, there are only two other connections between the plow and the vehicle besides the one between first hitch 24 and second hitch 26, namely, the two hydraulic connections in the hydraulic lines for hydraulic cylinders 34, 34'. One would normally use a conventional quick-disconnect fluid connector in the hydraulic lines between the vehicle and the hydraulic cylinders to make hitching and unhitching the plow as simple as possible.

Trip bias mechanism 58 is also connected to retaining rod 112. Trip bias mechanism 58 includes turnbuckle 64 connected to attachment rod 56 in cowling 18, a spring gang plate 148 connected to the other end of turnbuckle 64, and a series of two to five parallel trip springs 150 connected between gang plate 148 and retaining rod 112 depending on the trip tension desired. When the plow is being pushed forwardly and the blade strikes an object, the blade and the cowling will pivot about rod 112 from the first, vertical position shown in FIG. 4 toward or to the second, tripped position illustrated in FIG. 5, pulling turnbuckle 64 and stretching trip springs 150. When the object is cleared, trip springs 150 will pull the cowling and the blades back to the vertical position.

Plow 10 can be pivotally raised about an axis formed by rod 112 in slots 132, 132' such that blade 12 does not touch the ground by a vertical lifting chain 152 (FIG. 1) and a conventional lifting apparatus 154 mounted on the front of vehicle 22. Lifting apparatus includes a fluid cylinder 156 which raises chain 152. Cylinder 156 is operated through conventional valving by the same fluid/hydraulic pump on the vehicle which operates cylinders 34, 34'. When chain 152 is lifted, it pulls frame 20 by a loop 158 (FIGS. 4 and 5) welded to frame 20, causing frame 20 to pivot about retaining rod 112 in slots 132, 132'.

It can be seen that the hinge employed in the snowplow of the present invention is greatly reinforced by an elongated piece of folded metal forming an elongated apex between two apex plate portions of the cowling. This strengthens the hinge against bending and increases the life of the plow such that an articulated snowplow can be constructed in a relatively simple fashion from ordinary sheet metal. Furthermore, the trip bias mechanism of the present invention can be adjusted to increase or decrease the trip force required to trip the plow, without having to compress springs, which in many prior art designs limits the movement of the plow from the untripped to the tripped positions. The tension on the trip bias mechanism of the present invention can be adjusted with a turnbuckle which increases the length of the springs rather than compressing them or by adding or removing tension springs.

While one form of the invention has been shown and described, other embodiments will now be apparent to those skilled in the art. Therefore, it will be understood that the embodiments shown in the drawings and described above are merely for illustrative purposes and are not intended to limit the scope of the invention which is defined by the claims which follow.

The embodiments of the invention in which an exclusive property or privilege is claimed are defined as follows:

1. A hinged snowplow for vehicles comprising a support frame for attachment to a vehicle, said support frame having a free end; a cowling pivotally secured to said free end; a pair of plow blades pivotally secured to and extending from said cowling; first stop means connected to said cowling and engageable with said support frame to limit the pivotal movement of said cowling about said frame to a first position; second stop means connected with said cowling and engageable with said support frame to limit the pivotal movement of said cowling about said frame to a second position; said cowling including two apex plate means for supporting plow blades thereon, said apex plate means forming an elongated vertical apex when said cowling is in said first position and having portions extending away from said apex and receiving said free end of said frame therebetween; pivot means extending between said apex plate means and said frame free end for pivotally securing said cowling to said free end of said frame such that said cowling is pivotable in a generally vertical plane about said free end of said frame; said cowling further including hinge means secured to and extending along said apex, said blades being mounted on said cowling by said hinge means; trip bias means between said frame and cowling to bias said cowling to said first position where said blades are positioned for plowing, said cowling being rotatable against said trip bias means toward said second position when said blades hit an obstacle.

2. The snowplow as recited in claim 1 wherein said frame is T-shaped with the leg of said T comprising said free end, and the arms of said T being mounted to the vehicle.

3. The snowplow as recited in claim 1 wherein said trip bias means is mounted so as to extend in length when said cowling and blades pivot from said first toward said second positions.

4. The snowplow as recited in claim 3 wherein said trip bias means includes a trip coil spring which is stretched when said cowling and blades pivot from said first to said second positions.

5. The snowplow as recited in claim 4 wherein said trip bias means further includes trip spring tension adjustment means.

6. The snowplow as recited in claim 5 wherein said trip spring tension adjustment means includes a turnbuckle.

7. The snowplow as recited in claim 1 including attachment means for attaching said snowplow to a vehicle having first hitch means for mounting on the vehicle, and second hitch means mounted on said support frame for connection to said first hitch means; at least one of said first and second hitch means including projecting means for mounting said snowplow on the vehicle, the other of said first and second hitch means including slot means forming a slot for receiving said projecting means when said two hitch means are hitched together; one of said slot means and projecting means including movable pin means for locking said projecting means in said slot means for locking said two hitch means together.

8. The snowplow as recited in claim 7 including remote actuation means to move said movable pin.

9. A hinged snowplow for vehicles comprising a support frame for attachment to a vehicle, said support frame having a free end; a cowling pivotally secured to said free end so as to pivot in a generally vertical plane about said free end; first stop means connected to said cowling and engageable with said support frame to limit the pivotal movement of said cowling about said frame to a first position; second stop means connected with said cowling and engageable with said support frame to limit the pivotal movement of said cowling about said frame to a second position; a pair of plow blades pivotally secured to and extending from said cowling; trip bias means between said frame and cowling to bias said cowling to said first position where said blades are positioned for plowing, said cowling being rotatable against said bias means toward said second position when said blades hit an obstacle; said frame being T-shaped with the leg of said T comprising said free end and the arms of said T being mounted to the vehicle; said free end being received within said cowling, and said first stop means including stop plate means horizontally disposed in said cowling when said cowling is in said first position so as to abut said T frame leg and prevent rotation of said cowling and blades beyond said first position away from said second position.

10. The snowplow as recited in claim 9 wherein said second stop means comprises a bottom plate on said cowling.

11. The snowplow as recited in claim 9 which further includes an attachment rod mounted on said cowling to which said bias means is attached, said attachment rod and stop plate means being located above the point of pivotal attachment of said cowling to said free end.

12. The snowplow as recited in claim 11 wherein said attachment rod is located above said stop plate means; and a buttress plate is located between and secured to said attachment rod and stop plate means to reinforce said rod against bending from said bias means.

13. The snowplow as recited in claim 9 wherein said cowling is formed from two apex plate portions which form an elongated vertical apex when said cowling is in said first position, said cowling further including hinge means secured to and extending along said apex, said blades being mounted on said cowling by said hinge means, said cowling further including two substantially parallel wall portions spaced from each other, each extending from one of said apex plate portions, said stop plate means being located between said parallel wall portions.

14. The snowplow as recited in claim 13 wherein said cowling further includes a back plate which extends between and beyond the sides of said parallel wall portions, forming reinforcing wing members on either side of said cowling, and gusset members extending between said wing members and said parallel wall portions to reinforce said wall portions.

15. The snowplow as recited in claim 14 wherein said gusset members are located adjacent the point of pivotal attachment of said cowling to said free end.

16. The snowplow as recited in claim 14 wherein said back plate includes an opening through which said leg of said T-frame projects, said leg being located between and pivotally secured to said parallel wall portions.

17. A hinged snowplow for vehicles comprising a support frame for attachment to a vehicle, said support frame having a free end; a cowling pivotally secured to said free end so as to pivot in a generally vertical plane about said free end; first stop means connected to said cowling and engageable with said support frame to limit the pivotal movement of said cowling about said frame to a first position; second stop means connected with said cowling and engageable with said support frame to limit the pivotal movement of said cowling about said frame to a second position; a pair of plow blades pivotally secured to and extending from said cowling; trip bias means between said frame and cowling to bias said cowling to said first position where said blades are positioned for plowing, said cowling being rotatable against said bias means toward said second position when said blades hit an obstacle;

said attachment means for attaching said snowplow to a vehicle including first hitch means for mounting on the vehicle, and second hitch means mounted on said support frame for connection to said first hitch means; at least one of said first and second hitch means including projecting means for mounting said snowplow on the vehicle, the other of said first and second hitch means including slot means forming a slot for receiving said projecting means when said two hitch means are hitched together; one of said slot means and projecting means including movable pin means for locking said projecting means in said slot means to hold said two hitch means together;

said projecting means including at least one pair of spaced members forming a second slot; said slot means having a rod extending thereacross for receipt in said second slot between said spaced members of said projecting means.

18. The snowplow of claim 17 wherein said slot means include at least one pair of spaced members forming a first slot; said spaced members forming said first slot being oriented transverse to said spaced members forming said second slot; said rod extending transverse to said spaced members of said first slot.

19. The snowplow of claim 17 wherein said movable pin means is mounted on said spaced members forming said second slot for movement therebetween across said second slot to lock said rod when received in said second slot.

20. The snowplow of claim 19 wherein said projecting means is on said first hitch means and said slot means is on said second hitch means.

21. The snowplow as recited in claim 19 wherein said movable pin comprises a spring biased pin and a spring engaging said pin, said pin being movable against the bias of said spring out of said second slot.

22. A hinged snowplow for vehicles comprising a support frame for attachment to a vehicle, said support frame having a free end; a cowling pivotally secured to said free end so as to pivot in a generally vertical plane about said free end; first stop means connected to said cowling and engageable with said support frame to limit the pivotal movement of said cowling about said frame to a first position; second stop means connected with said cowling and engageable with said support frame to limit the pivotal movement of said cowling about said frame to a second position; a pair of plow blades pivotally secured to and extending from said cowling; trip bias means between said frame and cowling to bias said cowling to said first position where said blades are positioned for plowing, said cowling being rotatable against said bias means toward said second position when said blades hit an obstacle;

attachment means for attaching said snowplow to a vehicle including first hitch means for mounting on the vehicle, and second hitch means mounted on said support frame for connection to said first hitch means; at least one of said first and second hitch means including projecting means for mounting said snowplow on the vehicle, the other of said first and second hitch means including slot means forming a slot for receiving said projecting means when said two hitch means are hitched together; one of said slot means and projecting means including movable pin means for locking said projecting means in said slot means to hold said two hitch means together;

remote actuation means for moving said movable pin means; said remote actuation means including a shielded cable; said shielded cable including a control lever adapted for mounting in the cab of the vehicle for operation by the vehicle driver.

23. A hinged snowplow for vehicles comprising a support frame for attachment to a vehicle, said support frame having a free end; a cowling pivotally secured to said free end so as to pivot in a generally vertical plane about said free end; first stop means connected to said cowling and engageable with said support frame to limit the pivotal movement of said cowling about said frame to a first position; second stop means connected with said cowling and engageable with said support frame to limit the pivotal movement of said cowling about said frame to a second position; a pair of plow blades pivotally secured to and extending from said cowling; trip bias means between said frame and cowling to bias said cowling to said first position where said blades are positioned for plowing, said cowling being rotatable against said bias means toward said second position when said blades hit an obstacle;

attachment means for attaching said snowplow to a vehicle including first hitch means for mounting on the vehicle, and second hitch means mounted on said support frame for connection to said first hitch means; at least one of said first and second hitch means including projecting means for mounting said snowplow on the vehicle, the other of said first and second hitch means including slot means forming a slot for receiving said projecting means when said two hitch means are hitched together; one of said slot means and projecting means including movable pin means for locking said projecting means in said slot means to hold said two hitch means together;

said slot means including a rod extending thereacross for receipt in said projecting means, said movable pin means engaging said rod to lock said projecting means in said slot means; said rod forming a pivot axis by which the entire snowplow and support frame may be pivoted with respect to the vehicle.

24. A hinged snowplow for vehicles comprising a support frame for attachment to a vehicle, said support frame having a free end; a cowling pivotally secured to said free end so as to pivot in a generally vertical plane about said free end; first stop means connected to said cowling and engageable with said support frame to limit the pivotal movement of said cowling about said frame to a first position; second stop means connected with said cowling and engageable with said support frame to limit the pivotal movement of said cowling about said frame to a second position; a pair of plow blades pivotally secured to and extending from said cowling; trip bias means between said frame and cowling to bias said cowling to said first position where said blades are positioned for plowing, said cowling being rotatable against said bias means toward said second position when said blades hit an obstacle;

attachment means for attaching said snowplow to a vehicle including first hitch means for mounting on the vehicle, and second hitch means mounted on said support frame for connection to said first hitch means; at least one of said first and second hitch means including projecting means for mounting said snowplow on the vehicle, the other of said first and second hitch means including slot means forming a slot for receiving said projecting means when said two hitch means are hitched together; one of said slot means and projecting means including movable pin means for locking said projecting means in said slot means to hold said two hitch means together;

each of said projecting means and slot means including two slots, each of the two slots on said projecting means being receivable within a slot of said slot means, one of said projecting means and slot means having a rod extending across both of its slots, said movable pin means being on the other of said projecting means and slot means and including two movable pins, each of which is movable across one of said slots on said slot means, and means for moving said movable pins in tandem such that said movable pins will simultaneously release said rod.

25. The snowplow as recited in claim 24 wherein said means for moving said movable pins includes connection means which connects said two movable pins, and remote actuation means associated with said connection means for moving said connection means and movable pins in tandem.

26. The snowplow as recited in claim 24 wherein each of said slots is formed between a pair of ears, each of said ears having a portion which angles away from the ear with which it is paired so as to form a widened, tapering mouth portion for each of said slots to guide said said projecting means into said slots.

27. The snowplow as recited in claim 26 wherein said rod extends across both of said slots and between both of said pairs of ears on the said one of said projecting means and slot means; said trip bias means being connected to said rod.

28. The snowplow as recited in claim 27 wherein said frame is T-shaped with the leg of said T comprising said free end, and the arms of said T being mounted to the vehicle.

29. The snowplow as recited in claim 28 wherein said projecting means is associated with the arms of said T-frame, and said ears of said projecting means extend outwardly from said T-frame arms.

30. Attachment means for mounting an implement such as a snowplow having a support frame onto a vehicle comprising first hitch means for mounting on the vehicle and second hitch means mounted on said support frame for connection to said first hitch means; at least one of said first and second hitch means including projecting means for mounting said implement on a vehicle, the other of said first and second hitch means including slot means forming a slot for receiving said projecting means when said two hitch means are hitched together; one of said slot means and projecting means including movable pin means for locking said projecting means in said slot means to hold said two hitch means together; each of said projecting means and slot means including two slots, each of the two slots on said projecting means being receivable within a slot of said slot means, one of said projecting means and slot means having a rod extending across both of its slots, said movable pin means being on the other of said projecting means and slot means and including two movable pins, each of which is movable across one of said slots on said slot means, and means for moving said movable pins in tandem such that said movable pins will simultaneously release said rod.

31. The attachment means as recited in claim 30 wherein said means for moving said movable pins includes connection means which connects said two movable pins, and remote actuation means associated with said connection means for moving said connection means and movable pins in tandem.

32. The attachment means as recited in claim 30 wherein each of said slots is formed between a pair of ears, each of said ears having a portion which angles away from the ear with which it is paired so as to form a widened, tapering mouth portion for each of said slots to guide said bars into said slots.

33. The attachment means as recited in claim 32 wherein said rod extends across both of said slots and between both of said pairs of ears on the said one of said projecting means and slot means; trip bias means for biasing a pivotal implement into an upright position on the support frame being connected to said rod.

34. The attachment means as recited in claim 33 wherein said frame is T-shaped with the leg of said T comprising said free end, and the arms of said T being mounted to the vehicle.

35. The attachment means as recited in claim 34 wherein said projecting means is associated with the arms of said T-frame, and said ears of said projecting means extend outwardly from said T-frame arms.

36. A hinged snowplow for vehicles, comprising:

a support frame for attachment to a vehicle, said support frame having a free end;

a stamping having angled wall portions forming an elongated apex, said angled wall portions extending away from said apex and receiving said free end of said frame therebetween;

pivot means extending between portions of said angled wall portions and said frame end for pivotally securing said stamping to said free end of said frame such that said stamping is pivotable in a generally vertical plane about said free frame end;

hinge means mounted along said apex;

a pair of blade sections attached to said hinge means;

biasing means for biasing said stamping and blade sections to a first pivoted position for plowing, said bias means being yieldable when overcome by the force of the pivotal movement of said blade sections and stamping toward a second position about said free end.

37. An improved snowplow, comprising:

a snowplow blade;

a frame having a leg member with a free end and an arm member at the end of said leg member which is opposite to said free end;

a cowling including two apex plate means for supporting said snowplow blade thereon, said apex plate means forming an elongated vertical apex and having portions extending away from said apex and receiving said free end of said frame therebetween;

pivot means extending between said apex plate means and said frame free end for pivotally securing said cowling to said free end of said frame such that said cowling is pivotable in a generally vertical plane about said free end of said frame; said cowling further including hinge means secured to and extending along said apex, said blade being mounted on said cowling by said hinge means;

biasing means connected to and between said arm member and said cowling for biasing said cowling and blade to a first plowing position; and hitch means associated with said arm member for mounting said snowplow on a vehicle, whereby when said blade strikes a fixed object while being pushed by a vehicle, said blade will pivot against the bias of said biasing means from said first position toward a second position to pass over the object.

38. The improved snowplow as recited in claim 37 further including at least one gusset between said leg and arm members to reinforce said frame.

39. The improved snowplow as recited in claim 37 wherein said blade is a hinged blade with hinge means located at the point of pivotal attachment of said free end and said blade.

40. The improved snowplow as recited in claim 39 wherein said hinge means are mounted on said cowling.

41. An improved snowplow, comprising:

a snowplow blade;

a T-shaped frame having a leg member with a free end and an arm member perpendicular to said leg member, said blade being pivotally mounted on said free end of said leg member;

biasing means connected to and between said arm member and said blade for biasing said blade to a first plowing position; and hitch means associated with said arm member for mounting said snowplow on a vehicle, whereby when said blade strikes a fixed object while being pushed by a vehicle, said blade will pivot against the bias of said biasing means from said first position toward a second position to pass over the object; said hitch means including a slotted means extending from said arm member with a bar across said slotted means to receive an attachment member on said vehicle in said slotted means behind said bar.

42. The improved snowplow as recited in claim 41 wherein said biasing means is connected to and between said bar and said blade.

* * * * *

UNITED STATES PATENT AND TRADEMARK OFFICE

CERTIFICATE OF CORRECTION

PATENT NO. : 4,658,519

DATED : April 21, 1987

INVENTOR(S) : Philip J. Quenzi

It is certified that error appears in the above-identified patent and that said Letters Patent is hereby corrected as shown below:

Column 9, claim 17, line 38:

"said" should be deleted.

Signed and Sealed this

Sixth Day of October, 1987

*Attest:*

DONALD J. QUIGG

*Attesting Officer*

*Commissioner of Patents and Trademarks*